US010874188B2

(12) United States Patent
Kim et al.

(10) Patent No.: US 10,874,188 B2
(45) Date of Patent: Dec. 29, 2020

(54) FILLING ASSEMBLY FOR THE MANUFACTURING OF A PACKAGING AND DISPENSING DEVICE FOR DUAL CONTENT

(71) Applicant: L'OREAL, Paris (FR)

(72) Inventors: Jinseok Kim, Shanghai (CN); Stéphane Leroux, Chevilly la Rue (FR); Vincent Jacquart, Chevilly la Rue (FR)

(73) Assignee: L'OREAL, Paris (FR)

( * ) Notice: Subject to any disclaimer, the term of this patent is extended or adjusted under 35 U.S.C. 154(b) by 182 days.

(21) Appl. No.: 16/072,316

(22) PCT Filed: Jan. 25, 2016

(86) PCT No.: PCT/CN2016/072043
§ 371 (c)(1),
(2) Date: Jul. 24, 2018

(87) PCT Pub. No.: WO2017/127993
PCT Pub. Date: Aug. 3, 2017

(65) Prior Publication Data

US 2019/0053600 A1 Feb. 21, 2019

(51) Int. Cl.
*A45D 34/00* (2006.01)
*B65B 29/10* (2006.01)
(Continued)

(52) U.S. Cl.
CPC ..... *A45D 34/00* (2013.01); *A45D 34/045* (2013.01); *A45D 40/24* (2013.01); *B65B 3/04* (2013.01);
(Continued)

(58) Field of Classification Search
CPC ..... A45D 34/00; A45D 34/045; A45D 40/24; A45D 2200/053; A45D 2200/055;
(Continued)

(56) References Cited

U.S. PATENT DOCUMENTS 1,241,207 A * 9/1917 Gilbert ..... B05B 11/3011 222/341
2,311,367 A * 2/1943 Chambers ..... A45D 34/04 401/119
(Continued)

FOREIGN PATENT DOCUMENTS

CN 1077813 A 10/1993
CN 1204973 A 9/2005
(Continued)

*Primary Examiner* — Nathaniel C Chukwurah
*Assistant Examiner* — Lucas E. A. Palmer
(74) *Attorney, Agent, or Firm* — Polsinelli PC

(57) ABSTRACT

A filling assembly (12), comprising: a container (14) for storing a first fluid composition (38), a pipette (54) removably inserted in the container through an opening (22); and a plug (110) removably to a dispensing end (66) of the pipette, defining an inner compartment (112) isolated from the first fluid composition. The filling assembly comprises a holding element (56) configured to hold the pipette inside the container in a predetermined position while maintaining at least one aperture (70) within the opening, said aperture allowing for fluid communication between the outside and the inside of the container, so that the container and the pipette may be filled simultaneously with the first and second fluid compositions (38, 114) respectively, before assembling the second open end (62) of the pipette with a pressure supply device.

13 Claims, 2 Drawing Sheets

(51) Int. Cl.
*B65B 3/04* (2006.01)
*B65D 81/32* (2006.01)
*A45D 34/04* (2006.01)
*A45D 40/24* (2006.01)

(52) U.S. Cl.
CPC ..... *B65B 29/10* (2013.01); *B65D 81/3222* (2013.01); *A45D 2200/053* (2013.01); *A45D 2200/055* (2013.01); *A45D 2200/058* (2013.01); *A45D 2200/1045* (2013.01)

(58) Field of Classification Search
CPC ..... A45D 2200/058; A45D 2200/1045; B65B 3/04; B65B 29/10; B65D 81/3222
See application file for complete search history.

(56) References Cited

U.S. PATENT DOCUMENTS 2,689,150 A * 9/1954 Croce ..... B65D 83/685 239/308
2,781,063 A * 2/1957 Williams ..... B01L 3/0282 141/24
3,194,447 A * 7/1965 Brown ..... B05B 11/3039 222/321.9
3,870,147 A * 3/1975 Orth ..... B65D 81/3222 206/222
4,212,332 A * 7/1980 Kutik ..... B05B 11/0005 141/98
4,278,360 A * 7/1981 Lorscheid ..... B65D 47/12 401/151
4,376,591 A * 3/1983 Proffer ..... A45D 34/04 141/24
4,438,871 A * 3/1984 Eckert ..... B05B 11/0027 222/137
4,579,153 A * 4/1986 Goncalves ..... B01L 3/0282 141/23
4,871,092 A * 10/1989 Maerte ..... B05B 11/3008 222/153.13
4,955,745 A * 9/1990 Vauquelin ..... A45D 34/045 141/24
5,143,211 A * 9/1992 Miczka ..... B65D 81/3255 206/219
5,154,702 A * 10/1992 Foyil ..... B01L 3/0282 215/214
5,209,376 A * 5/1993 Dirksing ..... B65D 81/325 222/137
5,226,572 A * 7/1993 Gargione ..... B01L 3/0272 141/24
5,351,862 A * 10/1994 Weag ..... B05B 11/0048 222/145.3
5,614,172 A * 3/1997 Geimer ..... A61F 9/0008 424/405
5,848,730 A 12/1998 Kawase et al.
5,884,759 A * 3/1999 Gueret ..... B65D 51/2835 206/219
5,918,771 A 7/1999 Van Der Heijden
5,918,778 A * 7/1999 Schultz ..... B05B 11/3018 222/321.7
6,010,034 A * 1/2000 Walthers ..... A47G 19/2266 222/129
6,112,779 A * 9/2000 Camilla ..... A61J 1/2096 141/22
6,119,897 A * 9/2000 Boileau ..... B65D 83/32 222/78
6,705,493 B1 * 3/2004 Mijers ..... B05B 11/3015 222/321.7
6,770,056 B2 * 8/2004 Price ..... G01F 11/023 222/43
9,221,048 B2 * 12/2015 Duquet ..... A45D 34/04
9,347,811 B2 * 5/2016 Wang ..... B01L 3/0282
9,351,556 B2 * 5/2016 Kim ..... A45D 34/04
9,650,175 B2 * 5/2017 Wu ..... B65D 25/085
9,950,460 B2 * 4/2018 Klatt ..... B29C 49/12
2005/0242118 A1 11/2005 Van Der Heijden
2009/0211927 A1 8/2009 Wu
2010/0163441 A1 * 7/2010 Kim ..... B65D 51/2864 206/221
2011/0284123 A1 * 11/2011 Bouix ..... A45D 34/04 141/23
2013/0074983 A1 * 3/2013 Choi ..... B05B 11/3047 141/23
2013/0112314 A1 * 5/2013 Lee ..... A45D 34/04 141/23
2013/0192713 A1 * 8/2013 Drugeon ..... A45D 34/04 141/26
2014/0209639 A1 * 7/2014 Sasaki ..... B05B 7/0037 222/190
2014/0234007 A1 * 8/2014 Lee ..... A45D 34/00 401/121
2014/0361047 A1 * 12/2014 Lee ..... G01F 11/028 222/372
2015/0232240 A1 * 8/2015 Lee ..... A45D 34/04 220/288
2016/0150867 A1 * 6/2016 Lee ..... A45D 34/00 222/209
2016/0166046 A1 * 6/2016 Hwang ..... B65D 81/3255 206/221
2016/0280449 A1 * 9/2016 Mekata ..... B65D 83/42
2017/0231365 A1 * 8/2017 Choi ..... A45D 34/00 222/383.1
2018/0042363 A1 * 2/2018 Kim ..... A45D 34/045
2019/0021470 A1 * 1/2019 Kim ..... A45D 34/043
2019/0029401 A1 * 1/2019 Kim ..... A45D 34/00

FOREIGN PATENT DOCUMENTS

CN 1671479 A 9/2005
CN 101519153 A 9/2009
CN 101723139 A 6/2010
CN 203493018 U 3/2014
CN 104603019 A 5/2015
EP 1803368 A1 7/2007
KR 20120054715 A 5/2012
KR 20120125059 A 11/2012
KR 101373949 B1 3/2014
KR 101373949 B1 * 3/2014
KR 101430988 B1 8/2014
WO WO 03/106045 A1 12/2003
WO WO 2015012480 A1 1/2015
WO WO 2015 034165 A1 3/2015
WO WO-2016072673 A1 * 5/2016 ..... A45D 34/04

* cited by examiner

FILLING ASSEMBLY FOR THE MANUFACTURING OF A PACKAGING AND DISPENSING DEVICE FOR DUAL CONTENT

CROSS REFERENCE TO RELATED APPLICATIONS

This application is the National Phase of Application No. PCT/CN2016/072043 filed Jan. 25, 2016 under 35 U.S.C. § 119, the entire contents of which is hereby incorporated by reference.

The present invention relates to a filling assembly for the manufacturing of a packaging and dispensing device for fluid products, preferably cosmetic products. More specifically, the present invention relates to a filling assembly comprising: a container for storing a first fluid composition, said container comprising an opening; a pipette removably inserted in the container through the opening, said pipette having a first dispensing end and a second open end configured to be assembled to a pressure supply device; and a plug removably assembled to the dispensing end of the pipette, said assembled pipette and plug defining an inner compartment for temporarily storing a second fluid composition isolated from the first fluid composition.

The term "cosmetic product" is understood to mean a product as defined in Council Directive 1223/2009/EEC of 30 Nov. 2009.

Due to chemical reactions occurring in cosmetic compositions, it may be useful to provide a cosmetic product in the form of at least two distinct compositions which are mixed within a short time before use. Therefore, it is possible to manufacture and store the compositions separately, without degradation of the active components.

In such cases, it is advantageous to provide a packaging and dispensing device allowing an easy mixing of the at least two distinct compositions before application.

A packaging and dispensing device for dual content, as described above, is known from document WO2015/034165. This document describes a cosmetic container having dual contents and comprising a container body in which a first product is stored and a pipette assembly forming a storage space in which a second product is stored.

The pipette assembly is temporarily closed by a plug that is removed when the user draws the pipette out of the container for the first time.

After removal of the plug, the product can be released into the container where it mixes with the first product as with a regular pipette by increasing the pressure in the pipette through a piston or a compressible bellow.

After releasing and mixing of the second product, the pipette assembly can be used normally to withdraw and dispense a quantity of the mixed composition from the container.

However, the packaging and dispensing device of document WO2015/034165 involves many different parts; moreover, the filling of its different compartments with the distinct fluid compositions implies several steps, which are difficult to carry out in automation.

More specifically it is not possible to simultaneously fill the products in the device. One has to first fill the first product into the container and separately fill the second product into the pipette assembly with the plug on. Then the pipette assembly is assembled to the main container in order to close the device in a ready-to-use state.

An object of the present invention is to provide a filling assembly for the manufacturing of a packaging and dispensing device for dual content, allowing a simplified manufacturing and filling process.

To this end, the invention relates to a filling assembly as described above, comprising a holding element configured to hold the pipette inside the container in a predetermined position while maintaining at least one aperture within the opening, said aperture allowing for fluid communication between the outside and the inside of the container, so that the container and the pipette may be filled simultaneously with the first and second fluid compositions respectively, before assembling the second open end of the pipette with the pressure supply device.

According to advantageous embodiments, the filling assembly comprises one or more of the following feature(s), taken in isolation or according to any technically possible combination:

- the holding element extends between the pipette and a wall of the container, essentially perpendicularly to a longitudinal axis of the pipette;
- the holding element is attached to the pipette and removable from the container along with said pipette, said holding element resting on an edge of the opening;
- the edge of the opening is configured to block the holding element relative to the container, perpendicularly to a longitudinal axis of the pipette;
- the holding element is a flange fixed to and radially extending from the pipette, said flange comprising at least a first and preferably a second through-hole, radially situated between the pipette and the edge of the opening;
- the flange is made of an elastomeric material;
- the plug is coupled to the container, and preferably fixed to the container or slidably coupled to a lateral wall of the container;
- the filling assembly also comprises a pressure supply device configured to be assembled to the second open end of the pipette so as to close said second open end; preferably, the pressure supply device is also configured to be removably assembled to the container so as to close the opening.

The invention also relates to a method for the filling of a filling assembly as described above, said method comprising: filling the inner compartment with the second fluid composition through the second open end of the pipette; and filling the container with the first fluid composition through the at least one aperture within the opening.

According to advantageous embodiments, the method comprises one or more of the following feature(s), taken in isolation or according to any technically possible combination:

- at least one of the first and second fluid compositions is a liquid composition;
- the method comprises a further step of assembling the pressure supply device to the second open end of the pipette so as to close said second open end, thereby forming a packaging and dispensing device for fluid products.

The invention also relates to a packaging and dispensing device for fluid products, obtainable through such a method.

The invention will be better understood upon reading of the following description, taken solely as an example and made in reference to the following drawings, in which.

Figure 1:
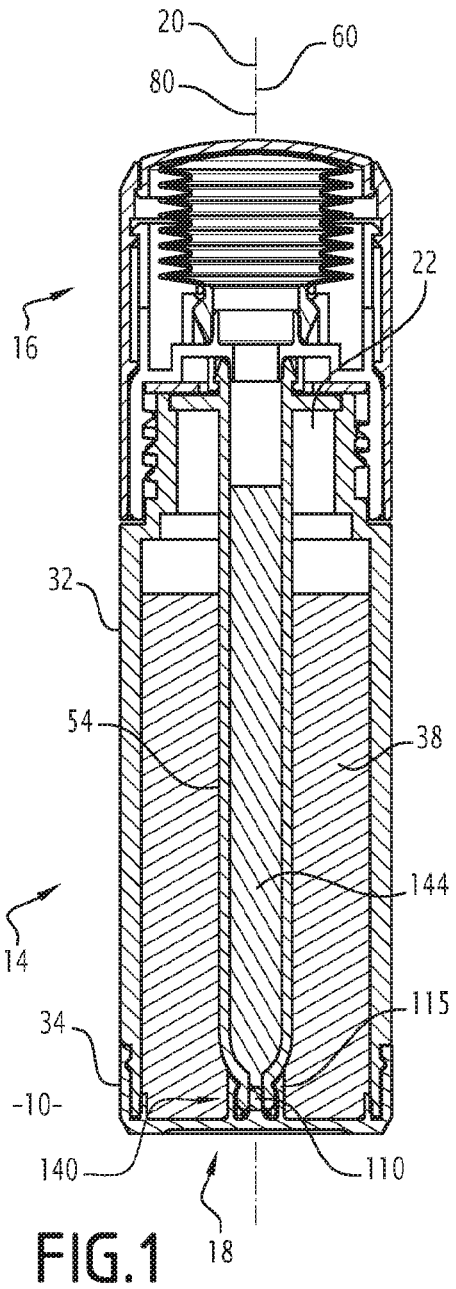
FIG. 1 is a cross-section view of a packaging and dispensing device according to a first embodiment of the invention.
Figure 3:
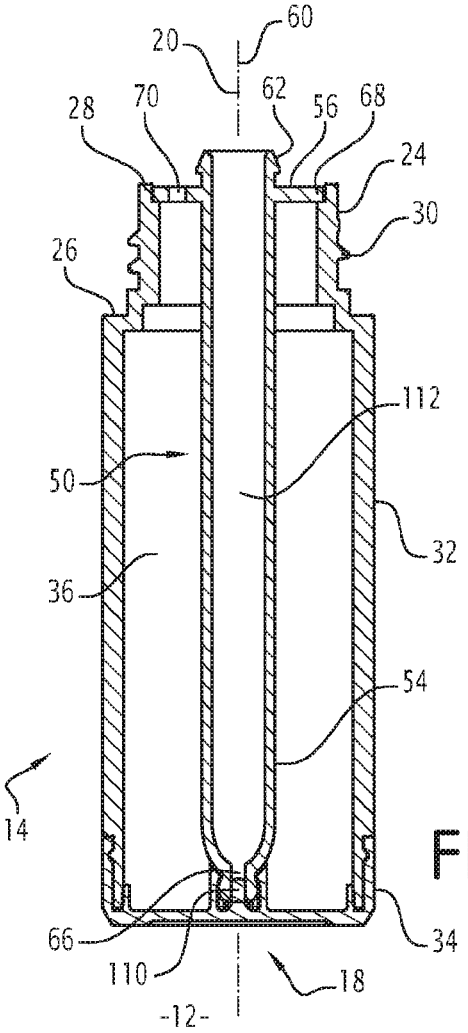
FIG. 3 is a cross-section view of a filling assembly for the manufacturing of the packaging and dispensing device of FIG. 1.
Figure 4:
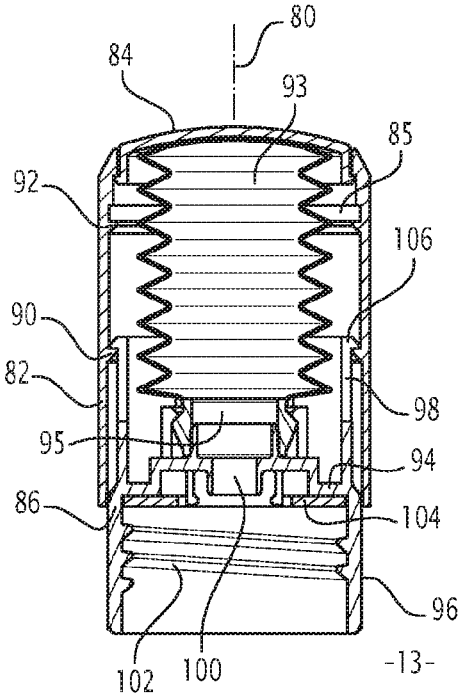
FIG. 4 is a cross-section view of a pressure supply device for the manufacturing of a packaging and dispensing device according to a first embodiment of the invention.

FIG. 1 shows a cosmetic packaging and dispensing device 10 according to a first embodiment of the invention. FIGS. 3 and 4 respectively show a filling assembly 12 and a pressure supply device 13, for the manufacturing of the packaging and dispensing device 10. A manufacturing process will be described below.

Figure 2:
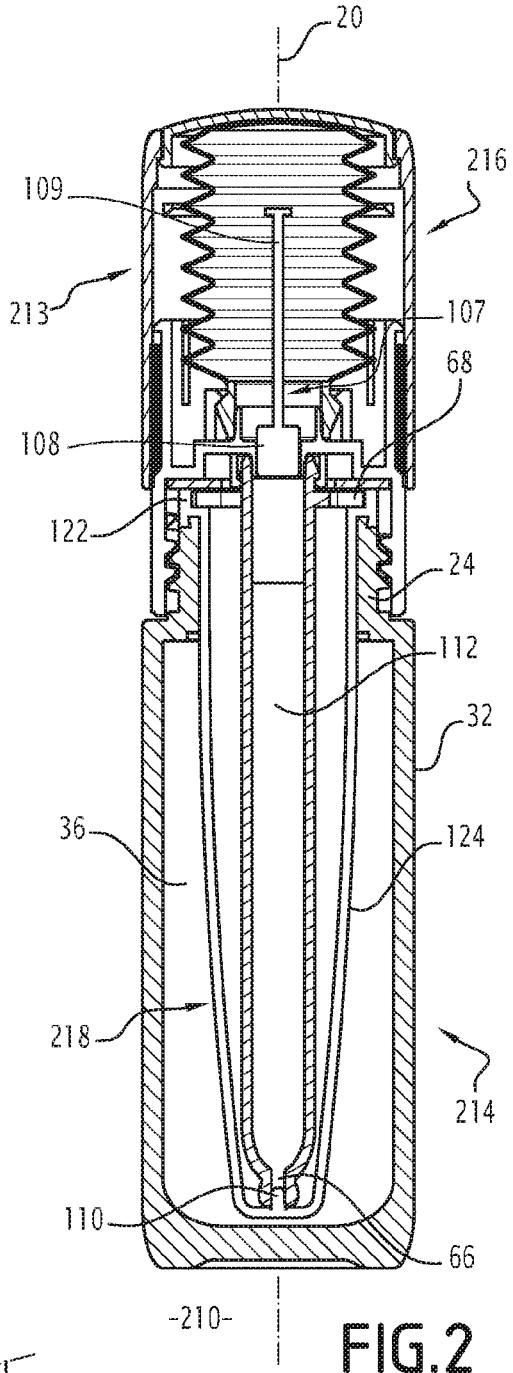
FIG. 2 is a cross-section view of a packaging and dispensing device according to a second embodiment of the invention.
Figure 7:
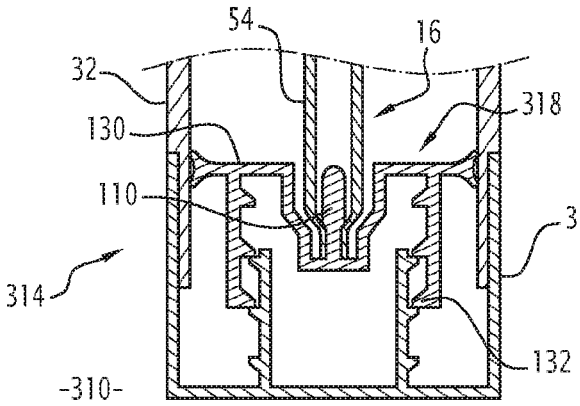
FIG. 7 is a schematic, detail cross-section view of a packaging and dispensing device according to a third embodiment of the invention.

FIG. 2 shows a cosmetic packaging and dispensing device 210 according to a second embodiment of the invention. FIG. 7 is a detail, schematic representation of a cosmetic packaging and dispensing device 310 according to a third embodiment of the invention. In the following description, the common elements of the devices 10, 210 and 310 are designed by the same reference numbers.

The cosmetic packaging and dispensing devices 210 and 310 are manufactured from filling assemblies (not shown) similar to the assembly 12, and from the pressure supply device 13 or a similar pressure supply device 213, according to the manufacturing process described below.

The cosmetic packaging and dispensing device 10, 210, 310 and the filling assembly 12 comprise a container 14, 214, 314. The cosmetic packaging and dispensing device 10, 210, 310 also comprise a closure member 16, 216 able to be reversibly assembled to the container 14, 214, 314. An assembled conformation of the container 14, 214, 314 and closure member 16, 216 is shown on FIGS. 1, 2 and 7. Only a lower part of the container 314 and closure member 16 are shown on FIG. 7.

The filling assembly 12 and the pressure supply device 13 of FIGS. 3 and 4 comprise elements for the manufacturing of the closure member 16; said elements will be described below.

The cosmetic packaging and dispensing device 10, 210, 310 and the filling assembly 12 also comprise a plugging device 18, 218, 318 assembled to the container 14, 214, 314. The plugging device 18, 218, 318 will be described below.

The container 14, 214 will be described below. Unless specified otherwise, the description also applies to the container 314 of FIG. 7.

The container 14, 214 mainly extends along a first longitudinal axis 20, considered vertical. In the following description, the terms "upper", "lower", "upwards", "downwards", will be understood with respect to said vertical axis 20, considering that the dispensing devices 10 and 210 are in the assembled conformation displayed on FIGS. 1 and 2.

A first axial end of the container 14, 214 is formed by an upper opening 22. Adjacent to the first axial end, the container 14, 214 comprises a neck 24 axially extending from a shoulder 26 to an upper edge 28, said upper edge defining the upper opening 22.

Preferably, the neck 24 has a mainly cylindrical shape. More preferably, an external surface of the neck 24 comprises an assembling element 30, such as threads, for assembling the neck 24 with the closure member 16.

The container 14, 214 also comprises a lateral wall 32 extending downwards from the shoulder 26. A second axial end of the container 14, 214 is formed by a bottom 34, 234.

In the embodiments of FIGS. 1, 2 and 3, the bottom 34, 234 is fixed to the lateral wall 32.

More precisely, in the embodiment of FIGS. 1 and 3, the bottom 34 of the container 14 is snap-fitted to the lateral wall 32. In the embodiment of FIG. 2, the bottom 234 of the container 214 is made one-piece with the lateral wall 32. This allows for making the container 214 out of glass for example.

In the embodiment of FIG. 7, the container 314 comprises a bottom 334 movably coupled with the lateral wall 32. Said bottom 334 will be described below.

The container 14, 214 defines a storing volume 36. Said storing volume 36 is filled with a first fluid composition 38, shown on FIG. 1.

The term "fluid composition" is preferably understood as "liquid composition" but may also include some solid compositions such as powders.

The closure member 16, 216 comprises the pressure supply device 13, 213 and a pipette member 50. In the devices 10, 210 of FIGS. 1 and 2, the pressure supply device 13, 213 and the pipette member 50 are connected to each other. The filling assembly 12 of FIG. 3 comprises a pipette member 50 unconnected to the pressure supply device 13.

Figure 5:
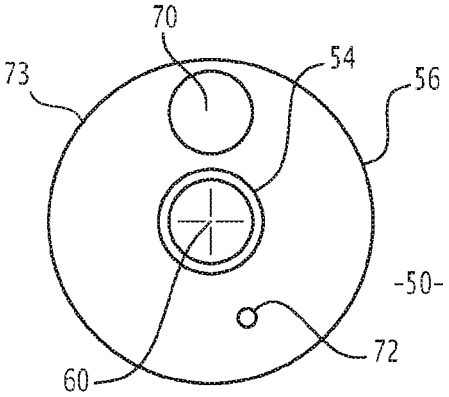
FIG. 5 is an upper view of an element of the filling assembly of FIG. 3.

The filling assembly 12 of FIG. 3 is formed by the pipette member 50 assembled to the container 14 and to the plugging device 18. FIG. 5 is an upper view of the pipette member 50.

In the embodiments of FIGS. 1, 2, 3 and 5, the pipette member 50 comprises a pipette 54 and a holding element 56. The pipette 54 is tubular and extends along a second axis 60. On FIGS. 1, 2 and 3, the pipette 54 is received inside the container 14, 214 and the first 20 and second 60 axes are coincident.

An upper end 62 of the pipette 54 is designed to be connected to the pressure supply device 13, 213. Preferably, the upper end 62 comprises a bulb edge to allow a snap-fit assembly with said pressure supply device 13, 213, as described below.

A lower end of the pipette 54 comprises an axial opening 66. Said lower end forms a dispensing end of pipette 54. Preferably, a section of the pipette constricts around the axial opening 66, in order to limit a liquid flow under gravity.

In the embodiments of FIGS. 1, 2, 3 and 5, the holding element 56 is a flange fixed to the pipette 54 near the upper end 62. The flange 56 is mainly washer-shaped and extends in a plane perpendicular to the second axis 60.

The flange 56 is configured to be in contact with the upper edge 28 of the neck 24 when the pipette 54 is received inside the container 14, 214. Preferably, the flange 56 is able to rest on the upper edge 28. More preferably, the upper edge 28 comprises a groove 68 forming a seat able to fit around the flange 56, so that radial movements of said flange are prevented when in contact with said seat.

The flange 56 comprises at least a first off-centered through hole 70. As shown on FIGS. 3 and 5, the off-centered through hole 70 is configured to be radially situated between the pipette 54 and the upper edge 28 of the neck 24 when the pipette 54 is received inside the container 14, 214. As described below, a diameter of the first off-centered through hole 70 is preferably sufficient to allow the insertion of an injection needle or nozzle.

Preferably, the flange 56 also comprises a second off-centered through hole 72, also configured to be radially situated between the pipette 54 and the upper edge 28 of the neck 24 when the pipette 54 is received inside the container 14, 214. Preferably, the second off-centered through hole 72 is of a diameter significantly smaller than the first off-centered through hole 70.

The second through hole 72 acts as a venting hole for letting out the air present in the container when filing through the aperture—in this embodiment, the first through hole 70.

In the embodiment of FIGS. 3 and 5, the first 70 and second 72 through-holes are distant from a peripheral edge 73 of the flange 56. In an alternative embodiment, the first 70 and/or second 72 through-hole(s) can be made as cut open on the peripheral edge 73, forming one or more notches in the flange 56.

According to a first embodiment, the pipette 54 and the flange 56 are made one-piece, for example of a thermoplastic material.

According to a second embodiment, the pipette 54 and the flange 56 are made of different materials and the flange is inserted around the pipette. For example, the pipette 54 is made of glass and the flange 56 is made of an elastomeric material.

According to another embodiment (not shown), the holding element 56 has a different shape; for example, the holding element comprises a plurality of linear elements or spokes radially extending from the pipette 54, said linear elements being spaced from each other.

According to another embodiment (not shown), the holding element 56 is fixed to an inside of the neck 24 or lateral wall 32 of the container 14, 214; said holding element is able to be removably assembled to the pipette 54. For example, the holding element comprises a central opening for inserting the pipette 54 when assembling said pipette with said container, so as to maintain the first 20 and second 60 axes coincident.

FIG. 4 shows the pressure supply device 13 in an unconnected configuration. The pressure supply device 13 substantially has a cylindrical external shape, extending along a third axis 80.

On FIGS. 1 and 2, the pipette member 50 and the pressure supply device 13, 213 are connected to each other to form the closure member 16, 216; the second 60 and third 80 axes are coincident. In the following description, the third axis 80 is considered vertical.

In the embodiments of FIGS. 1, 2 and 4, the pressure supply device 13, 213 is able to apply a variable pressure in the pipette 54. The pressure supply device 13, 213 may be in a first configuration, shown on FIGS. 2 and 4, or in a second configuration, shown on FIG. 1.

The pressure supply device 13, 213 comprises: a cap 82, a push-button 84, a spring membrane 85 and a connecting element 86.

The cap 82 has a substantially tubular shape extending along the third axis 80. The cap 82 comprises a first 90 and a second 92 inner rings, radially protruding from a cylindrical inner wall of the cap 82. The first 90 and second 92 inner rings both comprise a chamfer oriented downwards.

According to an embodiment, the first 90 and/or second 92 inner rings are continuous; according to another embodiment, the first 90 and/or second 92 inner rings are discontinuous, that is to say formed by curved segments separated by spaces.

The push-button 84 obstructs an upper end of the cap 82. Said push-button 84 is translatable relative to said cap 82 along the third axis 80.

The spring membrane 85 is received in the cap 82, in contact with the push-button 84. The spring membrane 85 defines a compressible chamber 93 of a variable volume. In the embodiments of FIGS. 1, 2 and 4, the spring membrane 85 has the shape of a bellows, with a single opening 95.

The spring membrane 85 is able to be compressed along the first axis 80. In the second configuration of the pressure supply device 13, shown on FIG. 1, the spring membrane 85 is more compressed than in the first configuration, shown on FIGS. 2 and 4. However, even in the first configuration, the spring membrane 85 is in a semi-compressed state and tends to push the push-button 84 upwards.

The amplitude of movement of the push-button 84 relative to the cap 82 is able to reversibly modify the volume of the compressible chamber 93, to a lesser degree than the difference between the first and second configurations.

The connecting element 86 has a substantially tubular lateral wall extending along the third axis 80. The connecting element 86 comprise an inner transversal wall 94 separating said connecting element 86 into a lower 96 and an upper 98 compartments. Said lower 96 and upper 98 compartments communicate through a central hole 100 in the inner transversal wall 94.

The lower compartment 96 is able to be assembled to the neck 24 of the container 14, 214. More specifically, the lower compartment 96 comprises internal threads 102 able to cooperate with the threads 30 of the neck 24.

On the side of the lower compartment 96, the inner transversal wall 94 preferably comprises a sealing device 104, such as a gasket or sealing joint, to ensure a tight connection between the container 14, 214 and closure member 16.

On the side of the lower compartment 96, the inner transversal wall 94 is designed to be assembled to the pipette member 50. More specifically, the upper end 62 of the pipette 54 is able to be snap-fitted to the inner transversal wall 94, around the central hole 100.

On the side of the upper compartment 98, the inner transversal wall 94 is assembled to the opening 95 of the spring membrane 85. In the unconnected configuration of FIG. 4, the compressible chamber 93 communicates with the lower compartment 96 through the central hole 100. In the devices 10, 210 of FIGS. 1 and 2, the compressible chamber 93 is connected to the pipette 54 and is able to modify a pressure inside said pipette.

An upper end of the upper compartment 98 comprises an outer ring 106, radially protruding from the lateral wall of the connecting element 86. Said outer ring 106 comprises a chamfer oriented upwards. Said outer ring 106 may be continuous or discontinuous, as defined above.

The connecting element 86 is slidably inserted into a lower end of the cap 82. In the first configuration of FIGS. 2 and 4, the spring force of the spring membrane 85 maintains the outer ring 106 of the connecting element 86 in contact with the first inner ring 90 of the cap 82. In the second configuration of FIG. 1, the spring force maintains the outer ring 106 in contact with the second inner ring 92 of the cap 82. In both cases, the chamfer-less sides of the inner and outer rings are in contact with each other.

In the embodiments of FIGS. 1, 2 and 4, as described below, the cap 82 is able to translate relative to the connecting element 86 along the first axis 80, from the first to the second configuration. The snap-fitting of the outer ring 106 with the second inner ring 92 irreversibly places the pressure supply device 13, 213 into the second configuration.

According to another embodiment (not shown), in place of the outer ring 106 and second inner ring 92, the cap 82 and connecting element 86 comprise locking elements able to reversibly maintain the pressure supply device in the second configuration. For example, these locking elements comprise a male pin and a female L-shaped slot forming a bayonet-type assembly.

The pressure supply device 213 of FIG. 2 only differs from the pressure supply device 13 of FIGS. 1 and 4 in that it also comprises a stopping member 107. Said stopping member 107 is received in the connecting element 86 and the spring membrane 85. The stopping member 107 comprises a stopper 108 and a rod 109.

When the pressure supply device 213 is in the first configuration of FIG. 2, the stopper 108 is tightly inserted in the central hole 100 of the connecting element 86. The stopper 108 has a smaller diameter than the pipette 54.

The rod 109 extends upwards from the stopper 108 in the compressible chamber 93. The rod 109 has a smaller radial dimension than the stopper 108.

When the pressure supply device 213 is in the first configuration, the stopper 108 isolates the spring membrane 85 and compressible chamber 93 from the contents of the pipette 54. When the cap 82 moves towards the second configuration, the rod 109 is pushed downwards by an upper end of the spring membrane 85. Therefore, the stopper 108 is released in the pipette 54, allowing fluid communication between said pipette and the compressible chamber 93.

The plugging device 18, 218, 318 comprises a plug 110 received in the container 14, 214, 314, near the bottom 34, 234, 334. The plug is preferably made of a deformable material. The plug 110 is preferably situated on the first axis 20.

In the assembled conformation of FIGS. 1, 2, 3 and 7, the plug 110 is inserted in the axial opening 66 of the pipette 54 so as to obstruct said axial opening 66. Therefore, in the assembled conformation of FIGS. 1, 2, 3 and 7, the pipette 54 and plug 110 define an inner compartment 112, isolated from the storing volume 36 of the container 14, 214, 314. Said inner compartment 112 is filled with a second fluid composition 114, shown on FIG. 1.

Preferably, the second fluid composition 114 is a liquid composition but may also be a powdery solid. According to a preferred embodiment, at least one of the first 38 and second 114 fluid compositions is a liquid composition.

The plug 110 is coupled to the container 14, 214, 314. As explained below, said coupling is able to prevent the plug to be ejected from the axial opening 66 of the pipette by an overpressure in the inner compartment 112, when the container and closing element 16 are assembled.

According to the embodiments of FIGS. 1, 2 and 3, the plug 110 is fixed to the container 14, 214. According to the embodiment of FIG. 7, the plug 110 is movable relative to the container 314.

In the embodiment of FIGS. 1 and 3, the plug 110 protrudes upwards from the bottom 34 of the container 14, said plug and bottom being preferably one-piece. The plugging device 18 also comprises a continuous or discontinuous ring 115, protruding upwards from the bottom 334 around the plug 110. As shown on FIGS. 1 and 3, when the axial opening 66 of the pipette 54 is assembled to the plug 110, the lower end of said pipette is inserted in the ring 115, strengthening the assembly.

Figure 6:
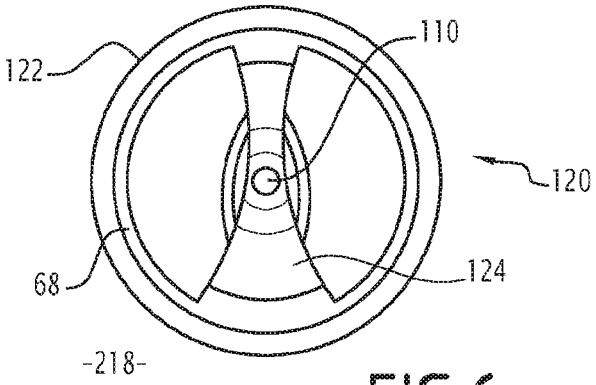
FIG. 6 is an upper view of an element of the packaging and dispensing device of FIG. 2.

FIG. 6 is an upper view of the plugging device 218 according to the embodiment of FIG. 2.

The plugging device 218 comprises a coupling member 120, attached to the plug 110 and preferably made one-piece with said plug. The coupling member 120 comprises an upper ring 122, attached to the neck 24 of the container 214. The upper ring 122 comprises a groove 68 forming a seat able to fit around the flange 56 of the pipette member 50, to prevent radial movements of said flange.

The coupling member 120 also comprises a U-shaped band 124 extending downwards from the upper ring 122. The plug 110 protrudes upwards from a lowest bend of the U-shaped band 124.

The U-shape band 124 comprises lateral surfaces that can be used for decorating purpose, for example for having a logo or drawing represented on at least one of said lateral surfaces. The lateral surfaces can be of the same width or of different widths. The drawing or logo can be viewed through a transparent container 214 and through a transparent formula as the first fluid composition 38. The container and formula may have an impact on the optical path and consequently have an optical effect (or lens effect) on how the drawing can look.

Preferably, in the embodiment of FIG. 2, the plug 110 is not in contact with the bottom 234 of the container 214. Therefore, said bottom 234 needs not be as precisely shaped as a bottom designed to be attached to the plug, such as in the embodiment of FIGS. 1 and 3.

In the embodiment of FIG. 7, the plugging device 318 comprises a piston 130 able to slide inside the lateral wall 32 of the container 314. The piston 130 is attached to the plug 110 and extends radially around said plug 110. Preferably, the piston 130 is made one-piece with the plug 110.

The piston 130 is coupled to the bottom 334 of the container 314. More specifically, the piston 130 is helically coupled to the bottom 334, by means of threads 132, whereas the bottom 334 is rotatable relative to the lateral wall 32. Therefore a rotation of the bottom 334 relative to the lateral wall 32 is converted into a translation of the piston 130 relative to said lateral wall.

According to an embodiment, the plugging device 18, 218, 318 comprises flow deflectors able to modulate the shape of a flow of second fluid composition 114 into the first fluid composition 38 when the plug 110 is removed from the axial end of the pipette. For example, in the embodiment of FIGS. 1 and 3, the ring 115 extends higher than the plug 110 and comprises vertical slots 140 able to separate a flow of second fluid composition 114, for aesthetic purpose.

A method for the manufacturing of the filling assembly 12 of FIG. 3 will now be described. The bottom 34 and plugging device 18 of FIGS. 1 and 3 are made one-piece, then snap-fitted to the lateral wall 32 to form the container 14. In a similar manner, the container 214 and plugging device 218 of FIG. 2 are assembled. In a similar manner, the container 314 and plugging device 318 of FIG. 7 are made separately and assembled.

Besides, the pipette 54 and holding element 56 of the pipette member 50 are made one-piece, or are made separately and assembled.

Then, the pipette 54 is introduced into the container 14, 214, 314 and the plug 110 is inserted into the axial opening 66, thereby forming the isolated inner compartment 112. The flange 56 is put into contact with the upper edge 28 of the neck 24. Preferably, the flange 56 is received into the groove 68 and radially blocked.

The filling assembly 12 is then in the configuration shown on FIG. 3. The upper opening 22 of the container 14, 214, 314 is partially obstructed by the flange 56; the storing volume 36 communicates with the outside of the container 14, 214, 314 through the first 70, and preferably second 72, off-centered through holes of said flange 56.

A method for the manufacturing of the pressure supply device 13, 213 will now be described. The cap 82, push-button 84, spring membrane 85 and connecting element 86 are made separately. The cap 82 is assembled with the push-button 84 and the spring membrane 85 is snap-fitted to the inner transversal wall 94 of the connecting element 86. In the case of the pressure supply device 213, the stopping member 107 is inserted into the spring membrane 85 and central hole 100.

Then, the lower end of the cap 82 is inserted around the spring membrane 85 and connecting element 86, by translation along the third axis 80. The push-button 84 comes into contact with, and partially compresses the spring membrane 85. The outer ring 106 of the connecting element 86 comes into contact with the first inner ring 90 of the cap 82, on the chamfered sides. As the translation movement is continued, said outer ring 106 and first inner ring 90 snap-fit with each other; the pressure supply device 13, 213 is thereby assembled.

A method for the manufacturing of the devices 10 and 210, starting from the filling assembly 12 or a similar assembly, will now be described. The following method may be used for the manufacturing of device 310.

The inner compartment 112 is filled with the second fluid composition 114, through the open upper end 62 of the pipette 54. Then, the storing volume 36 of the container 14, 214 is filled with the first fluid composition 38, through the first off-centered through hole 70.

Preferably, the filling of the storing volume 36 is carried out by an injection needle or nozzle inserted into the first off-centered through hole 70. Preferably, the second off-centered through hole 72 serves as an air-release valve during the filling of the storing volume 36, allowing a quick, and preferably automated, process.

After the filling of the inner compartment 112 and storing volume 36, the lower compartment 96 of the pressure supply device 13, 213 is screwed onto the neck 24 of the container 14, 214. During the screwing process, the upper end 62 of the pipette 54 snap-fits with the inner transversal wall 94 of the connecting element 86. Said upper end 62 is therefore closed by the spring membrane 85. In the same manner, the first 70 and second 72 off-centered holes are closed by contact with the inner transversal wall 94 or with the sealing joint 104.

In the cases where the flange 56 is made of a suitable material, such as an elastomer, the screwing of the lower compartment 96 onto the neck 24 compresses said flange with a tightness effect. In such embodiments, the sealing joint 104 may be suppressed if the shape of the inner transversal wall 94 allows the closing of the first 70 and second 72 off-centered holes.

The pipette member 50 and the pressure supply device 13, 213 are thereby assembled, forming the closure member 16, 216. In the same manner, said closure member 16, 216 is assembled with the container 14, 214, forming the device 10, 210 in an assembled conformation. The pressure supply device 13, 213 is in the first configuration of FIG. 2.

Preferably, the device 10, 210 is marketed in said assembled conformation/first configuration, the first 38 and second 114 fluid compositions being isolated from each other. In the case of the device 210, the stopper 108 of the pressure supply device 213 also prevents the second fluid composition 114 from being spilled inside the compressible chamber 93 during transport and storage.

The number of different parts in the device 10, 210 is much lower than the number of parts in the devices of the state of the art. In the same manner, the manufacturing method described above is easy to carry out, even as an automated process.

A method for the use of the devices 10 and 210 will now be described. Starting from the assembled conformation/first configuration described above, a user pushes the cap 82 and push-button 84 downwards, relative to the connecting element 86 and to the rest of the device 10, 210. In the case of the pressure supply device 213, the rod 109 of the stopping member 107 is pushed downwards and the stopper 108 is released in the pipette 54, allowing fluid communication between said pipette and the spring membrane 85. The cap 82 translates until the second inner ring 92 snap-fits with the outer ring 106 of the connecting element 86, in a similar manner as described above for the first inner ring 90.

The pressure supply device 13, 213 is then maintained in the second configuration of FIG. 1, with a compressed spring membrane 85. The volume of the compressible chamber 93 is reduced, thereby increasing the pressure in the inner compartment 112, in comparison with the first configuration.

The device allows the application of a significant pressure in the inner compartment 112, while maintaining the pressure supply device 13, 213 in the second configuration and the plug 110 in the axial opening 66 of the pipette 54.

The user then unscrews the closing member 16, 216 from the container 14, 214. The axial opening 66 of the pipette 54 is separated from the plug 110. The pressure pushes the second fluid composition 114 out of the pipette 54 into the storing volume 36, allowing an efficient mixing with the first fluid composition 38.

Optionally, the shape of the flow of second fluid composition 114 is modulated by the flow deflectors 140 of the plugging device 18, 218. In function of the respective viscosities of the first 38 and second 114 fluid compositions, different visual effects may be obtained during the mixing.

A ready-to-use cosmetic product is thereby obtained. Then, the user can activate the push-button 84 to suck up application doses of the cosmetic product into the pipette 54, by means of the volume variation of the spring membrane 85.

According to the embodiment of FIG. 7, the plug 110 may be pulled out of the axial opening 66 without separating the container 314 and closing member 16. For example, the user rotates the bottom 334 relative to the lateral wall 32 of the container 314, thereby moving the piston 130 downwards, that is to say opposite to the neck 24. As a consequence, the plug 110 is extracted from the pipette 54. In the meantime, the pressure decreases in the storing volume 36. Due to the difference of pressure between the pipette 54 and the storing volume 36, the second fluid composition 114 exits the pipette 54 and efficiently mixes with the first fluid composition 38.

In the embodiment of FIG. 7, the pressure increase in the inner compartment 112 may be combined with the pressure decrease in the storing volume 36 for mixing the fluid compositions 38, 114. However, in another embodiment, only the pressure decrease is used to mix the fluid compositions 38, 114. For example, the pressure supply device 13 is put into the second configuration before being assembled to the pipette member 50; the device 310 is therefore marketed with the pressure supply device 13 in the second configuration.

The invention claimed is:

1. A method for the filling of a filling assembly comprising: a container for storing a first fluid composition, said container comprising an opening;

a pipette removably inserted in the container through the opening, said pipette having a first dispensing end and a second open end configured to be assembled to a pressure supply device; and a plug removably assembled to the dispensing end of the pipette, said assembled pipette and plug defining an inner compartment for temporarily storing a second fluid composition isolated from the first fluid composition, the filling assembly a holding element configured to hold the pipette inside the container in a predetermined position while maintaining at least one aperture within the opening, said aperture allowing for fluid communication between an outside and an inside of the container, so that the container and the pipette may be filled simultaneously with the first and second fluid compositions respectively, before assembling the second open end of the pipette with the pressure supply device, said method comprising:

filling the inner compartment with the second fluid composition through the second open end of the pipette; and filling the container with the first fluid composition through the at least one aperture within the opening.

2. A method according to claim 1, wherein at least one of the first and second fluid compositions is a liquid composition.

3. A method according to claim 1 for the filling of a filling assembly also comprising a pressure supply device configured to be assembled to the second open end of the pipette so as to close said second open end, said method comprising a further step of assembling the pressure supply device to the second open end of the pipette so as to close said second open end, thereby forming a packaging and dispensing device for fluid products.

4. A packaging and dispensing device for fluid products, obtainable through a method according to claim 3.

5. The packaging and dispensing device according to claim 4, wherein the holding element extends between the pipette and a wall of the container, perpendicularly to a longitudinal axis of the pipette.

6. The packaging and dispensing device according to claim 4, wherein the holding element is attached to the pipette and removable from the container along with said pipette, said holding element resting on an edge of the opening.

7. The packaging and dispensing device according to claim 6, wherein the edge of the opening is configured to block the holding element relative to the container, perpendicularly to a longitudinal axis of the pipette.

8. The packaging and dispensing device according to claim 6, wherein the holding element is a flange fixed to and radially extending from the pipette, said flange comprising at least a first and preferably a second through-hole, radially situated between the pipette and the edge of the opening.

9. The packaging and dispensing device according to claim 8, wherein the flange is made of an elastomeric material.

10. The packaging and dispensing device according to claim 4, wherein the plug is coupled to the container.

11. The packaging and dispensing device according to claim 10, wherein the plug is fixed to the container.

12. The packaging and dispensing device according to claim 10, wherein the plug is slidably coupled to a lateral wall of the container.

13. The packaging and dispensing device according to claim 4, wherein the pressure supply device is also configured to be removably assembled to the container so as to close the opening.

* * * * *